US006202963B1

(12) United States Patent
Derman

(10) Patent No.: US 6,202,963 B1
(45) Date of Patent: Mar. 20, 2001

(54) RAZOR AND TOOTHBRUSH HOLDER ATTACHMENT FOR STAND UP DISPENSER TUBES

(76) Inventor: Jay S. Derman, P.O. Box 3823, Palos Verdes, CA (US) 90274-9533

( * ) Notice: Subject to any disclaimer, the term of this patent is extended or adjusted under 35 U.S.C. 154(b) by 0 days.

(21) Appl. No.: 09/379,661

(22) Filed: Aug. 24, 1999

Related U.S. Application Data

(60) Provisional application No. 60/098,192, filed on Aug. 27, 1998.

(51) Int. Cl.[7] ..... A46B 17/02; B65D 1/40; B65D 69/00

(52) U.S. Cl. ..... 248/110; 248/682; 220/735; 206/228

(58) Field of Search ..... 248/110, 113, 248/213.2, 205.3, 205.4, 229.26, 230.7, 231.81, 313, 316.1, 316.7, 682; 206/228; 220/785

(56) References Cited

U.S. PATENT DOCUMENTS

D. 294,457 * 3/1988 Doty et al. ..... D8/373
390,089 * 9/1888 McClelland ..... 222/80
971,818 * 10/1910 Barker ..... 222/93
2,970,720 * 2/1961 Dooley, Jr. ..... 220/735
3,486,630 * 12/1969 Ellman ..... 211/13.1
4,141,445 * 2/1979 Korich ..... 206/228
4,232,785 * 11/1980 Lucas ..... 206/228
4,320,832 * 3/1982 Edstrom ..... 206/228
4,575,038 * 3/1986 Moore ..... 248/505
4,646,999 * 3/1987 Clark ..... 248/682
4,695,029 * 9/1987 Fox et al. ..... 248/682
5,544,783 * 8/1996 Conigliaro ..... 220/735
5,558,247 * 9/1996 Caso ..... 220/735
5,806,669 * 9/1998 Kim ..... 206/228
5,992,678 * 11/1999 Willey ..... 220/735

* cited by examiner

*Primary Examiner*—Anita M. King
(74) *Attorney, Agent, or Firm*—Monty Koslover

(57) ABSTRACT

A device for holding toilet accessories, that is attached to a stand up tubular can such as shaving gel. The invention is a wide, plastic clip, having a generally "U" shape with two arms shaped to grasp the circumference surface of a stand up tubular can. The front of the clip is flat and includes a stub projecting inwards from its inside surface. This stub creates two equal spaces and edges for storing items such as a shaver and a toothbrush. Provision is made for placing a hotel logo or company advertisement on the front facing surface of the clip for distribution. The device can also include a bonding agent to fasten the holder to a vertical flat surface and will support a light, tubular can or other tubular shaped item for display.

2 Claims, 4 Drawing Sheets

RAZOR AND TOOTHBRUSH HOLDER ATTACHMENT FOR STAND UP DISPENSER TUBES

This application claims the benefit of Provisional No. 60/098,192 filed Aug. 27, 1998.

BACKGROUND OF THE INVENTION

1. Field of the Invention

This invention relates to toiletry accessories, and more particularly, to convenience attachments for organizing toiletry.

2. Background

Every traveler who uses hotels and motels will be familiar with the sundry toilet accessories provided by the hotels and motels for use by their guests, and also for taking home. These accessories invariably carry the hotel logo or motel name prominently displayed, as an ongoing advertisement to their guest for future stays.

When a wet shaver and shaving gel is used by a traveler, the shaver usually has to be placed somewhere on a counter top near the shaving gel. Similarly, unless the hotel provides toothbrush holders, toothbrushes also are placed on a counter top. Ladies hygiene and makeup requirements may require using stand up tubular cans, with brushes or similar items near at hand. Home use applications are similar and various companies may wish to distribute the holders for advertising purposes.

It would therefore be useful to have available, a holder attachment for stand up tubular cans that is designed to conveniently hold accessories such as a wet shaver and toothbrush or other items.

SUMMARY OF THE INVENTION

The invention is a wide, plastic clip, having a general "U" shape and its two arms curved to flexibly grasp the circumference surface of a stand up tubular can. The front member of the clip is flat and includes a divider member protruding inwards from the front member inside surface, causing the clip front to stand away from a tubular can to which it is attached. The divider creates two equal spaces for storing items such as a shaver or toothbrush. Provision is made for placing a logo, hotel name or product advertisement on the front facing surface of the clip. The device is also modified to bond to a vertical flat surface and support a light, tubular can.

It is a prime object of this invention to provide a simple holder attachment to stand up tubular cans such as shaving gel, capable of holding a wet shaver and a toothbrush or other toilet accessories.

Another object is to provide a holder attachment that can be used to display a hotel logo, company name or product advertisement.

An advantage of the invention is that it is relatively inexpensive as a hotel or company advertising giveaway.

Further objects and advantages of the invention will be apparent from studying the following portion of the specification and the attached drawings.

DESCRIPTION OF THE PREFERRED EMBODIMENT

Figure 1:
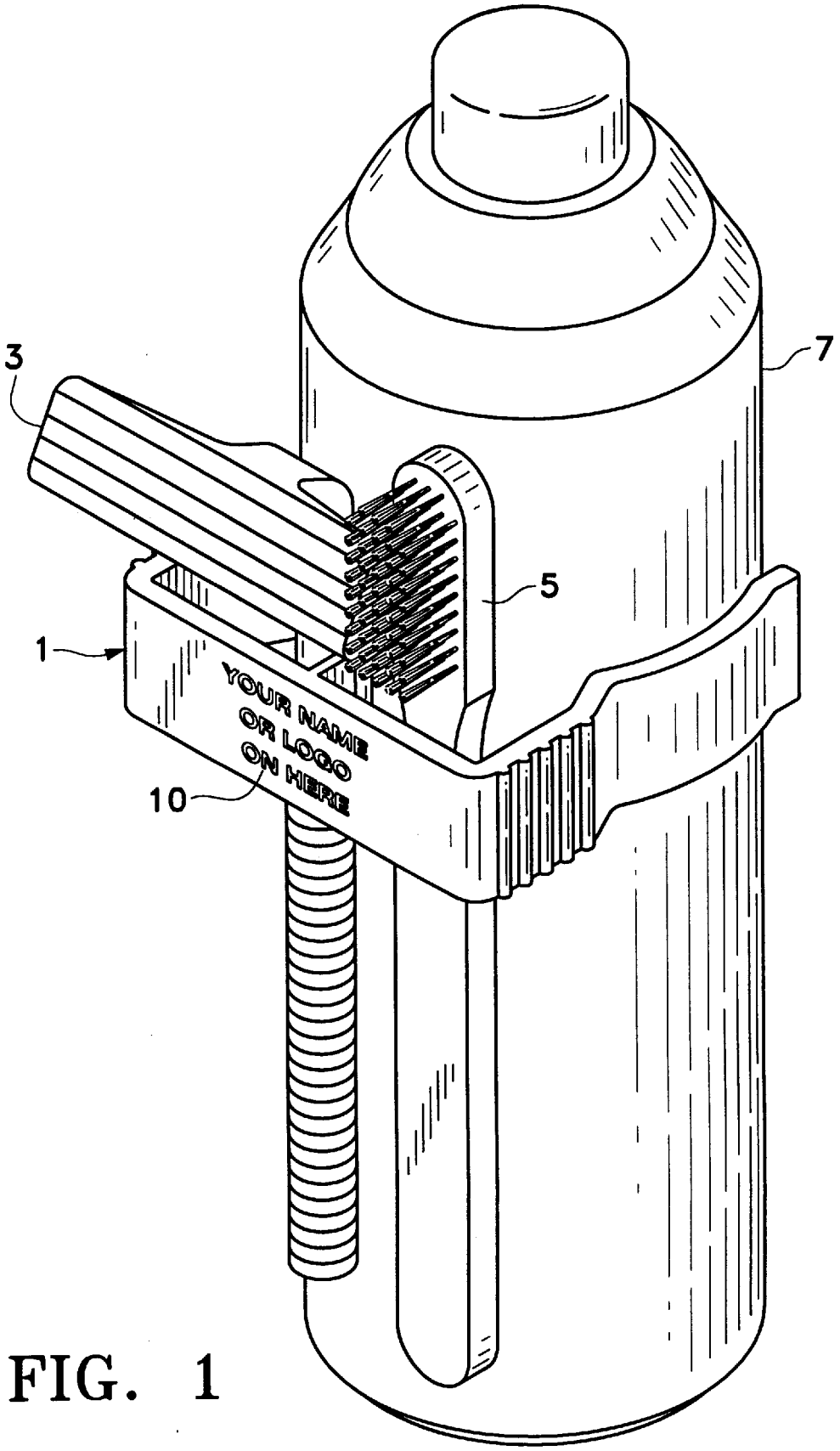
FIG. 1 is a front perspective view of the invention holder attachment, attached to a stand up gel shaving can, and holding a wet razor and a toothbrush.

Referring particularly to the drawings, there is shown in FIG. 1 a front perspective view of a holder attachment 1 according to the present invention, holding a wet razor 3 and a toothbrush 5 while mounted to a stand up shaving gel tubular can 7. On the front surface of the holder 1 can be seen a name or logo 10. This area is intended as an advertising space for the use of a hotel or company that distributes the holder.

The holder attachment 1 can be made in sizes to fit various diameter stand up tubular cans and be attached to tubular cans other than for shaving gel. Similarly, toiletry items other than razors and toothbrushes can be stored and hung from the holder attachment 1, so that the holder attachment 1 has a relatively broad application.

Figure 2:
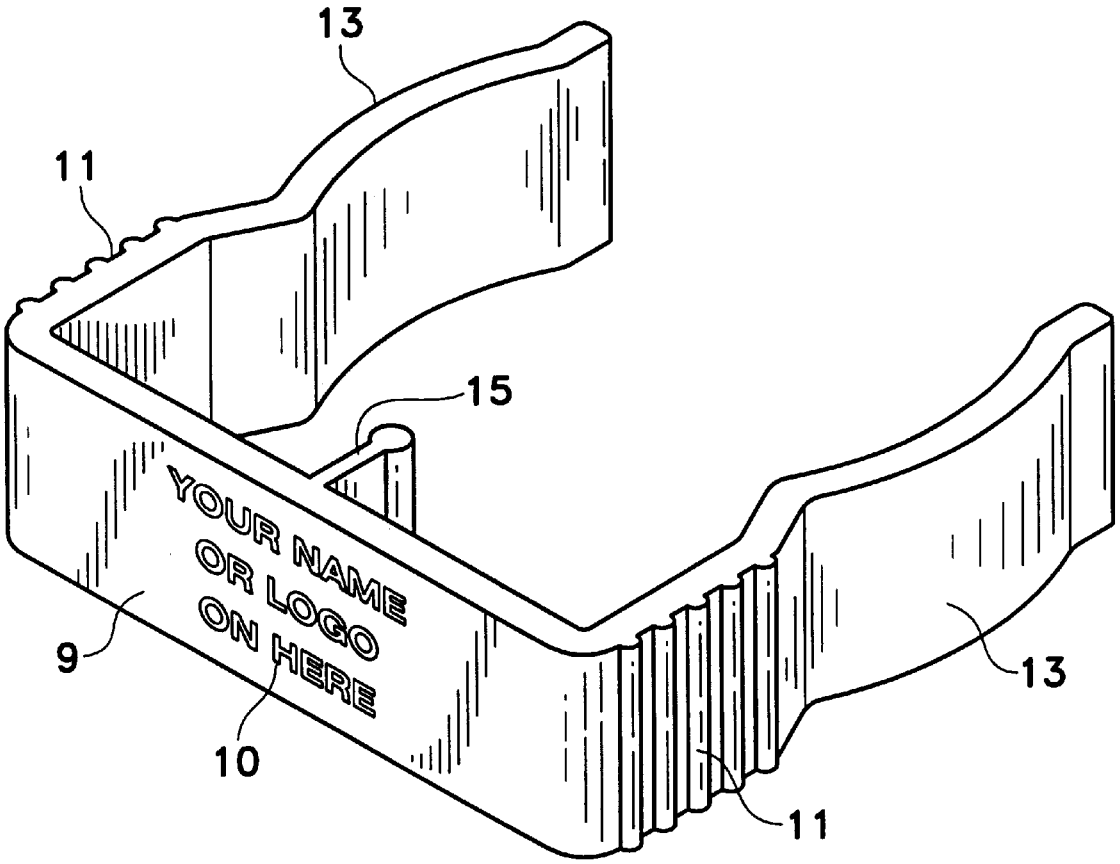
FIG. 2 is a front perspective view of a holder attachment according to the present invention.
Figure 3:
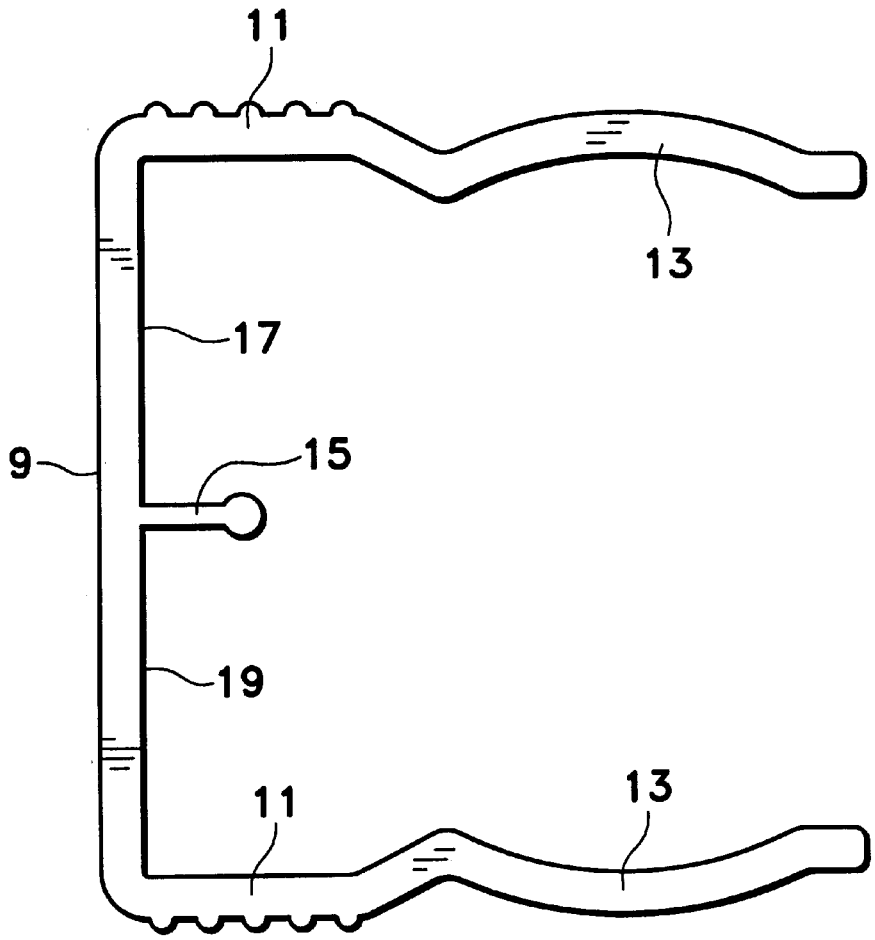
FIG. 3 is a plan view thereof.
Figure 4:
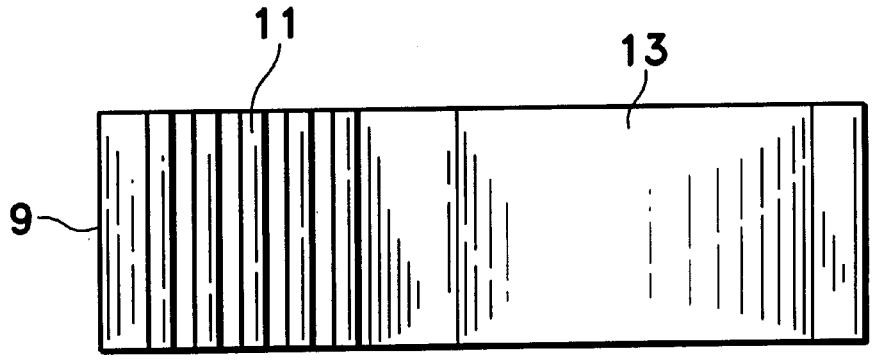
FIG. 4 is a right side elevation view of the present invention, the left side elevation being a mirror image thereof.

Refer now to FIGS. 2, 3 and 4 which are views of the invention holder attachment 1. The holder attachment is made from a polypropylene hard plastic material and formed in an approximate "U" shape. A wide portion which can be considered the bottom of the "U", has a flat front surface 9 on which a hotel name or company logo 10 can be imprinted. The two arms of the holder are identical in shape. Each arm comprises a flexible portion 11, connected at 90 degrees to the plane surface 9 of the wide portion, and a rigid curved portion 13 that is shaped concave inwards. Thus, the two concave shaped portions 13 of the arms face each other to clamp any appropriately sized tubular object.

The flexible portions 11 each include a number of vertical grooves and raised ridges along their outer surface to produce a springy elastic quality of the arms, when the arms curved portions are applied to clamp the circumference surface of a tubular can.

Referring particularly to FIG. 3, a divider projection 15 is located attached to the rear surface of the wide portion, approximately midway between the holder arms. The projection 15 forms two equal length spaces 17, 19 that become compartments when the holder attachment 1 is clamped to a tubular can, and the projection 15 end bears against the tubular can 7 surface as illustrated in FIG. 1. The compartments so formed by the holder bearing against the tubular can, provide space for a shaver or toothbrush, and a ledge to support the stored items.

The holder is small in size, light weight and can be fabricated in sizes to fit a number of different diameter stand up cylindrical containers. It provides a convenient surface to promote publicity and goodwill for establishments such as hotels and companies and would most likely be appreciated by everyone as an handy convenience for displaying toilet accessories.

An alternative use of the holder 1 requiring a modification, is to use the device to hold paint cans or similar cans on a wall. The modification needed is the addition of a fastening means to the device.

Figure 5:
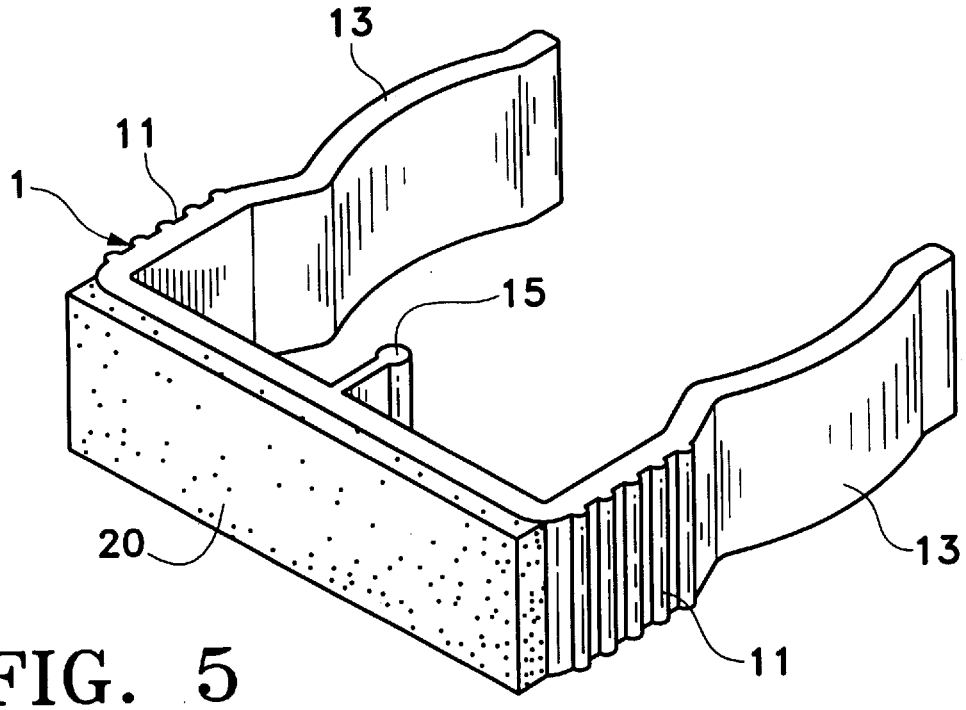
FIG. 5 is a perspective view of a modified holder attachment according to the present invention, particularly showing a bonding agent for fastening the holder attachment to a support surface.
Figure 6:
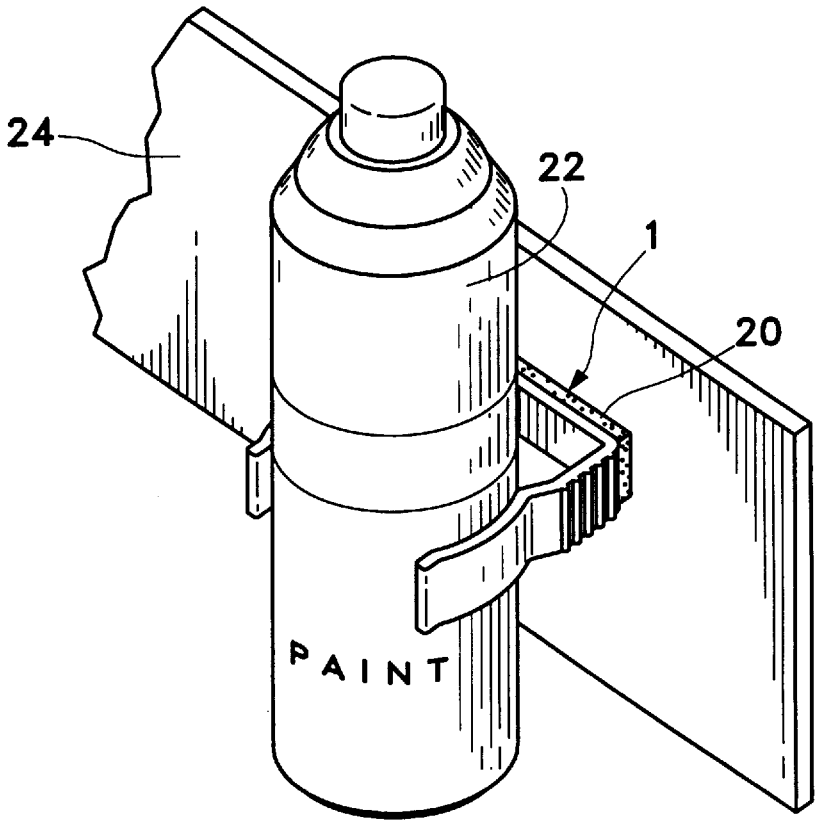
FIG. 6 is a perspective view of a paint can being held by the above modified holder attachment against a flat, vertical surface.

As shown in FIG. 5, the preferred fastening means is a bonding layer 20 which is joined to the face of the device wide portion. FIG. 6 shows the holder 1 fastened to a wall surface 24 by the bonding layer 20, enabling the device to clamp a tubular can 22 with its curved portions and hold the can 22 to the wall 24.

Other bonding means such as screws may be used to mount the holder 1 to a given wall, depending on whether the wall surface material can be made to grip the fasteners securely.

From the above description, it is clear that the preferred embodiment of the holder attachment achieves the objects of the present invention. Alternative embodiments and various modifications may be apparent to those skilled in the art. These alternatives and modifications are considered to be within the spirit and scope of the present invention.

Having described the invention, what is claimed is:

1. A holder attachment for a stand-up dispenser tubular can, said holder attachment being made of a hard-elastic plastic material and comprising a generally planar strip portion, and two identical resilient arm members that are spaced apart in parallel and connected to opposite ends of said strip portion, defining a substantially U-shaped member; said arm members each comprising a springy formed portion and a concave curved portion, said arm members being connected to said strip portion by their springy formed portion defining a shoulder, and oriented so that said concave portions turn inwards and directly oppose each other forming a clamp with which to grasp the circumference of said tubular can; said strip portion having an outer surface and an inner surface including a stub portion located equidistant from each end of said strip portion and projecting normal to said inner surface for the purpose of engaging said tubular can, said stub portion creating two equal spaces and edges for holding small toiletry items when said tubular can is grasped by said attachment holder; said outer surface of said strip portion providing an area suitable for displaying advertising or a logo.

2. A holder attachment for a dispenser tube, said holder attachment being made of a hard-elastic plastic material and comprising a generally planar strip portion, and two identical resilient arm members that are spaced apart in parallel and connected to opposite ends of said strip portion, defining a substantially U-shaped member; said arm members each comprising a springy formed portion and a concave curved portion, said arm members being connected to said strip portion by their springy formed portion defining a shoulder, and oriented so that said concave portions turn inwards and directly oppose each other forming a clamp with which to grasp the circumference of said tube; said strip portion having an outer surface and an inner surface including a stub portion located equidistant from each end of said strip portion and projecting normal to said inner surface for the purpose of engaging said tube; said strip portion including a bonding means attached to said outer surface for the purpose of fastening said holder attachment to a plane vertical surface.

* * * * *